US005718397A

United States Patent [19]

Stevens

[11] Patent Number: 5,718,397

[45] Date of Patent: Feb. 17, 1998

[54] REEL HAVING CONCENTRIC FLANGE SUPPORTS

[75] Inventor: James Stevens, Castleton, N.Y.

[73] Assignee: Sonoco Products Company, Inc., Hartsville, S.C.

[21] Appl. No.: 771,819

[22] Filed: Dec. 23, 1996

[51] Int. Cl.[6] ..... B65H 75/18

[52] U.S. Cl. ..... 242/608.8; 242/614.1; 242/118.4; 242/613.4

[58] Field of Search ..... 242/608.8, 609.4, 242/611, 613.4, 614, 614.1, 118.4, 118.41, 118.6, 118.61, 118.62, 118.7, 118.8

[56] References Cited

U.S. PATENT DOCUMENTS

| | | | |
|---|---|---|---|
| 2,121,234 | 6/1938 | Howsam | 242/608.8 |
| 2,321,084 | 6/1943 | Howsam et al. . | |
| 2,331,954 | 10/1943 | Atwood . | |
| 2,996,265 | 8/1961 | Bieber et al. | 242/118.61 |
| 3,468,495 | 9/1969 | Starratt | 242/118.8 |
| 3,591,103 | 7/1971 | Mahner et al. | 242/118.7 |
| 3,591,104 | 7/1971 | Mahner et al. | 242/118.7 |
| 3,743,208 | 7/1973 | Schmitz | 242/118.6 |
| 4,471,920 | 9/1984 | Ditton et al. | 242/118.61 |
| 5,409,180 | 4/1995 | Stewing | 242/584 |

*Primary Examiner*—John M. Jillions

*Attorney, Agent, or Firm*—Seidel, Gonda, Lavorgna & Monaco, PC

[57] ABSTRACT

A reel is provided for the winding and unwinding of wire or the like. The reel includes a cylindrical hub having a pair of flanges, one at each end of the hub. The hub includes an inner cylindrical wall defining a central hollow bore through the center of the reel. An outer cylindrical wall is provided concentrically around the inner wall and forms a barrel surface for the winding of the coiled wire (or the like) thereon. The flanges serve to protect the wire wound on the barrel surface. A frusto-conical or tapered wall is provided at opposite ends of the reel to connect the inner wall of the hub to the radially projecting flange. The frusto-conical wall includes at least one opening or window therein, providing a handle for lifting the reel from a package or carton. The reel may also be provided with a series of concentric cylindrical support ribs within the hollow portion defined by the flanges. Other structural support members may also be provided by the internal structures of the reel.

8 Claims, 5 Drawing Sheets

REEL HAVING CONCENTRIC FLANGE SUPPORTS

FIELD OF THE INVENTION

The present invention relates to a reel or spool for the high speed unwinding and winding of wire or the like thereon. Preferably, the spool includes a series of concentric supports within its flanges. In addition, a series of windows are provided within the central bore area to allow for ease of lifting of the reel from a container or the like.

BACKGROUND OF THE INVENTION

Reels or spools for the retention of a coiled wire, thread, yarn or the like are well known in the art. Many structural variations are provided on these known reels, dependant on the performance characteristics and requirements of the user of the reel.

One form of reel includes a cylindrical hub and a pair of flanges at each end of the hub. The hub includes a concentric inner and outer cylindrical walls and defines a central hollow bore through the center. The flanges include an upper and lower wall which are connected to one another by a series of concentric flange supports. A tapered cone area is provided adjacent the central bore which connects the inner wall of the hub to the upper wall of the flange. The tapered cone area also provides a drive engagement surface for a spindle which causes rotation of the reel for the winding and unwinding of the wire or the like.

The construction of the known reel has created certain handling problems. The surfaces of the cone and inner bore have made it difficult to remove the reel from containers, cartons or from the spindle.

BRIEF DESCRIPTION OF THE INVENTION

The present invention relates to a reel for the winding and unwinding of wire or the like. The reel includes a cylindrical hub having a pair of flanges, one at each end of the hub. The hub includes a inner cylindrical wall defining a central hollow bore through the center of the reel. An outer cylindrical wall is provided concentrically around the inner wall. A hollow area is defined between the inner wall and the outer wall. The outer wall defines a barrel surface for the winding of the coiled wire (or the like) thereon. Each flange on the reel extends radially outwardly from the barrel surface. The flanges serve to protect the wire wound on the barrel surface. Frusto-conical or tapered walls are provided to connect the inner wall of the hub to the outwardly projecting portion of the flanges. The frusto-conical walls include at least one opening or window therein, providing a handle for lifting the reel.

One embodiment of the reel of the present invention may comprise flanges having a first wall connected to the barrel surface and projecting radially outward therefrom and a second wall spaced from and parallel to the first wall. A cylindrical edge wall is provided to connect the first wall to the second wall at the outer peripheral edges thereof. The second wall extends inwardly from the edge wall and is connected to the frusto-conical wall. Means is provided within the space between the walls for stiffening the flanges so as to limit the flexure thereof in the axial direction of the reel. The stiffening means may comprise a series of concentric support ribs joining the first and second walls at various radial positions between the edge wall and the frusto-conical wall. A series of ribs extending radially outwardly from the frusto-conical wall and engaging the outer wall of the hub may also be provided. The radial ribs may extend between the first and second walls of the flanges so as to further stiffen the flanges. The radial ribs may also engage the concentric ribs within the flanges.

Further features of the present invention will become apparent by reviewing the detailed description thereof.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
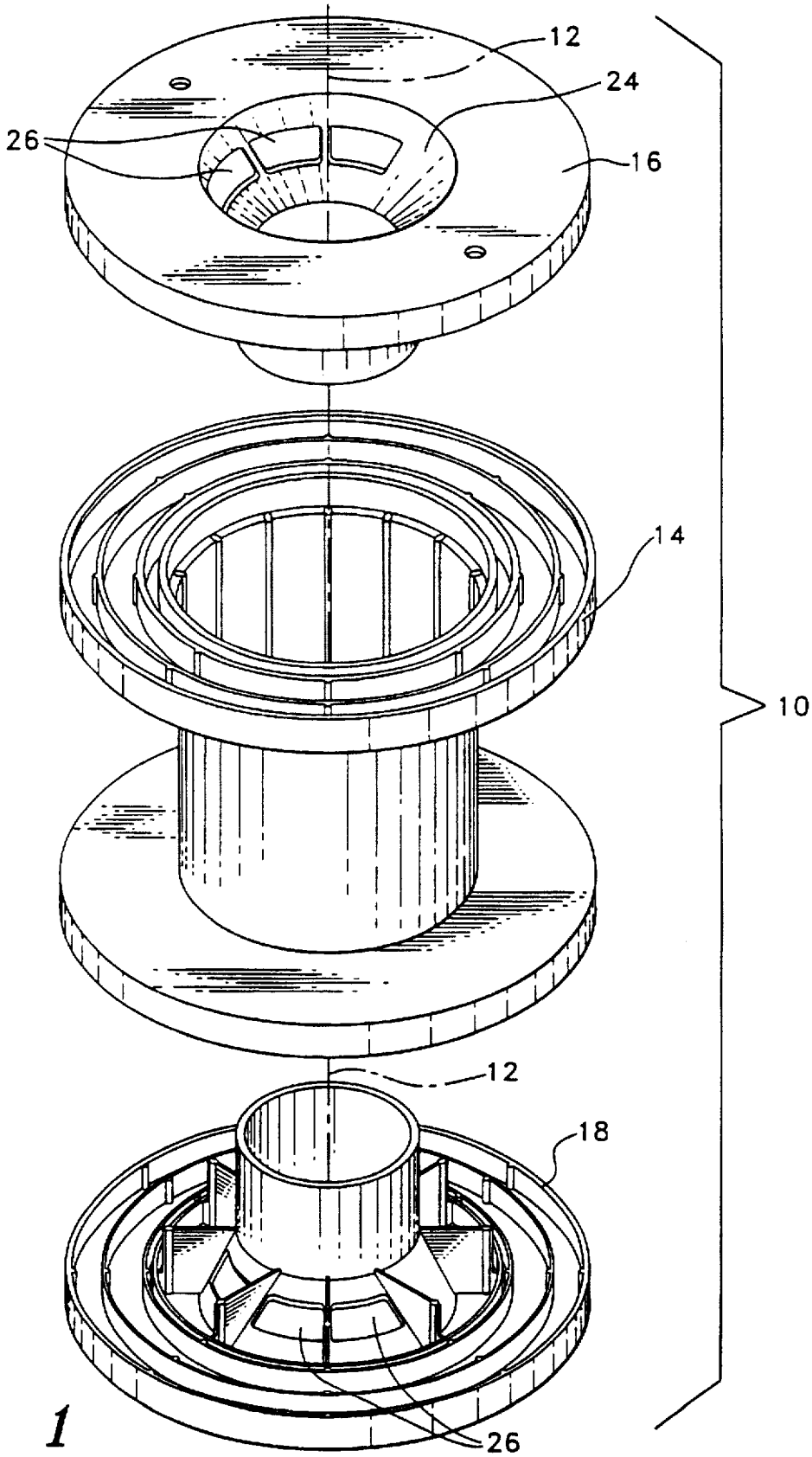
FIG. 1 is an exploded view of a reel as contemplated by the present invention.

In the drawings, where like numerals indicate like elements, there is shown a reel or spool as presently contemplated by the present invention and generally designated by the numeral 10. The reel 10 in FIG. 1 is shown with its elements in an exploded condition along the central axis thereof 12. The reel 10 as illustrated, generally comprises a base portion 14, a top portion 16 and a bottom portion 18. As illustrated, the top portion 16 and the bottom portion 18 are identical in structure. The top portion 16 is inserted at one end of the base portion 14 while the bottom portion 18 is inserted into the opposite end of the base portion 14. It being understood, however, that the base portion 14 may be inverted and, therefore, the bottom portion 18 would be placed on top while the top portion 16 would be positioned on the bottom.

Figure 2:
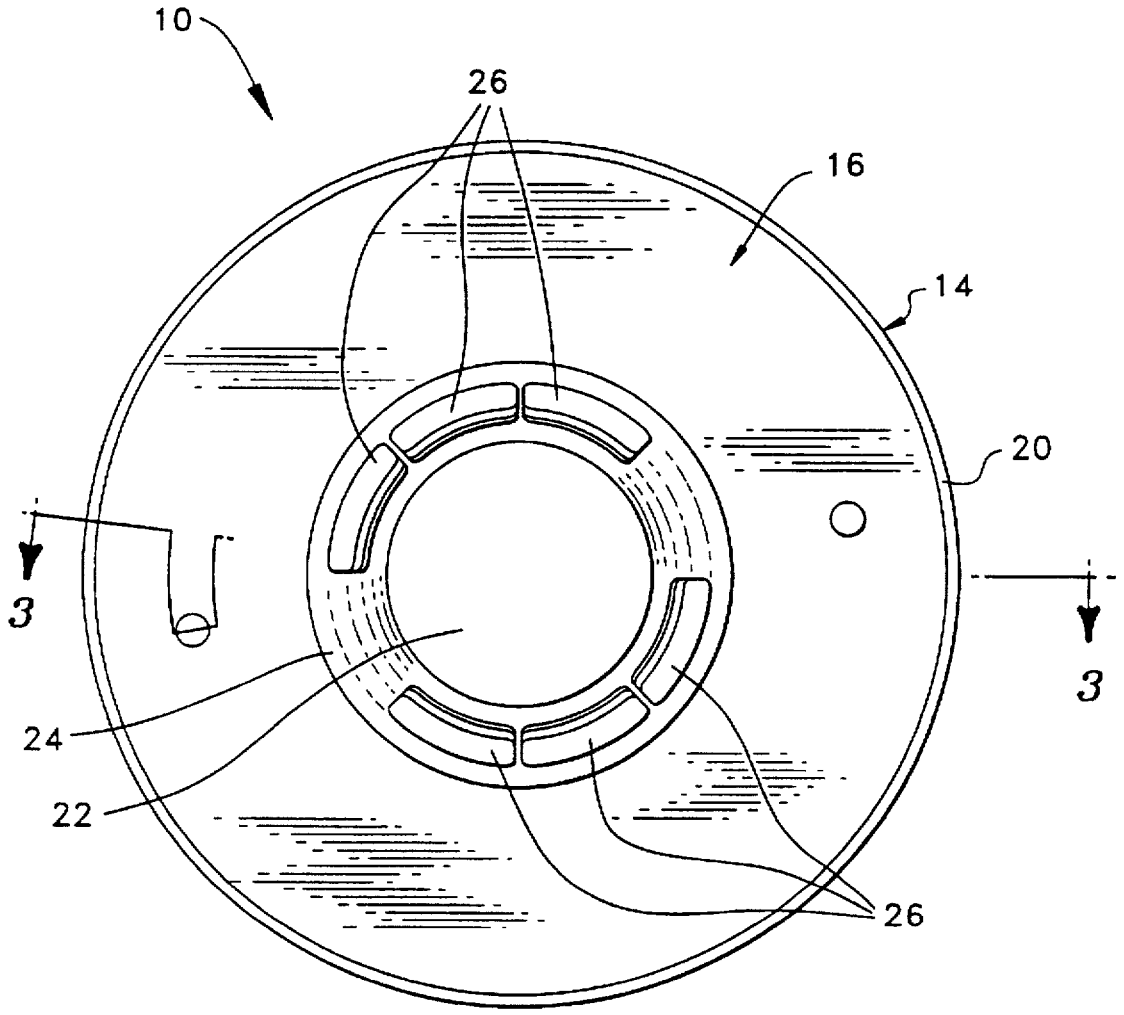
FIG. 2 is a top plan view of the reel shown in FIG. 1.

In FIG. 2, the reel 10 is shown looking downward on the top portion 16. The top portion 16 is inserted into the base portion 14 such that an edge wall 20 surrounds the outside edge of the top portion 16. As illustrated, the reel 10 defines a central hollow bore 22. At the top of the bore is provided a tapered wall 24 having a series of windows or openings 26 therein.

Figure 3:
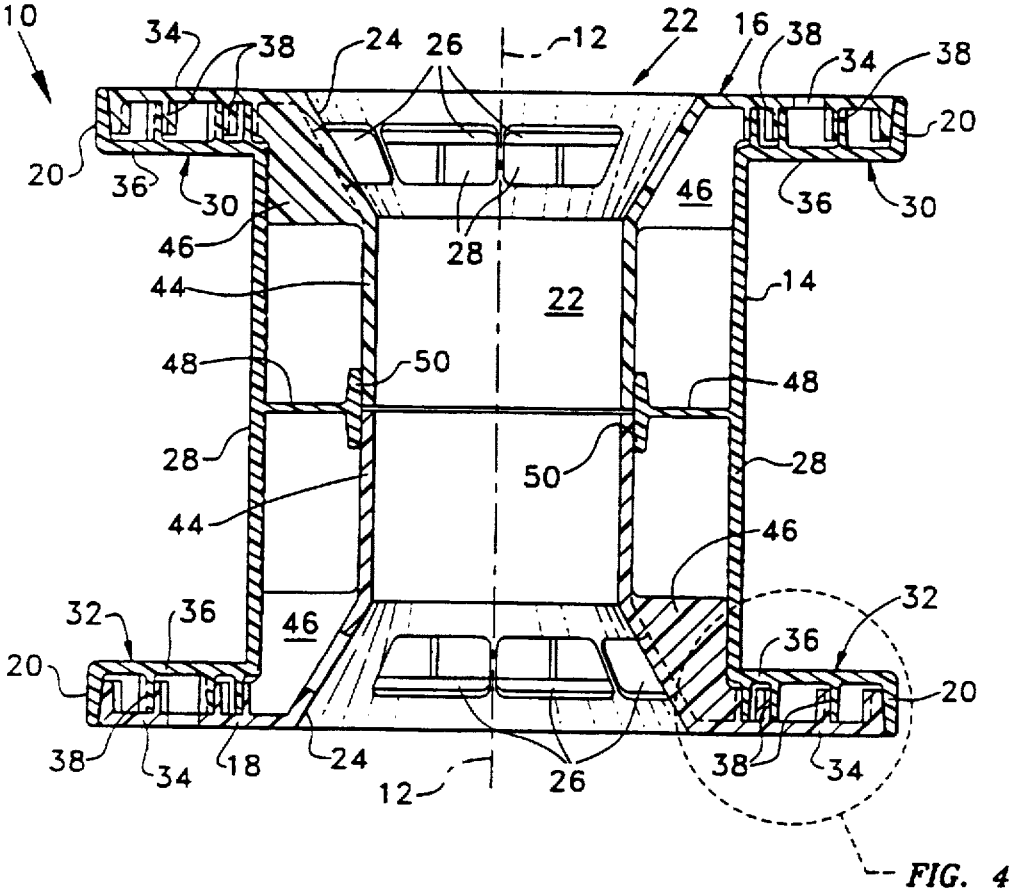
FIG. 3 is a cross-sectional view of the reel as taken along line 3—3 in FIG. 2.

In FIG. 3, the reel 10 is shown in cross-section and in the assembled condition. The base portion 14 includes an outer cylindrical wall 28 and two flanges 30, 32, one on each end of the outer wall 28. The cylindrical wall 28 is concentrically formed around the central axis 12. The flanges 30, 32 project radially outwardly from the outer wall 28, perpendicular to the outer wall 28 and the central axis 12. The edge wall 20 projects axially from the upper surface of the flanges 30, 32 and is generally formed concentric with and parallel to the outer wall 28. The outer wall 28, in combination with other elements, forms a cylindrical hub for the reel 10 with the outside surface of the outer wall 28 forming a barrel surface for receipt and support of the coiled winding of wire or the like thereon.

The top portion 16 of the reel 10 includes an outer flange surface or wall 34 which extends radially from the central axis 12. The base portion 14 in forming the flange 30 (as well as flange 32) defines an inner flange wall 36. The outer flange wall 34 of the top portion 16 is positioned generally parallel to the inner flange wall 36 of the base portion 14 when in the assembled condition. The outer wall 34 and the inner wall 36 of the flange 30 (and of flange 32 formed adjacent to the bottom portion 18) define a hollow area therebetween, with the radial peripheral edge being defined by the edge wall 20.

Within the hollow area between the outer wall 34 and the inner wall 36 of the flange 30 is provided a series of concentric cylindrical support ribs 38. The cylindrical ribs 38 are generally formed by an engagement of projecting portions formed on the lower surface of the outer wall 34 of top portion 16 and the upper surface of the inner wall 36 on base portion 14. The interengagement of the projections from the outer flange wall 34 and the inner flange wall 36 to form the support ribs 38 is more particularly shown in FIG. 4 with respect to the formation of the lower flange 32. It should be generally understood that the formation of the upper flange 30 by the interengagement of the base portion 14 and the top portion 16 is substantially identical thereto.

Each rib 38 within flange 32 includes an outer flange projection 40 and an inner flange projection 42. The inner flange projection 42 extends outwardly from the lower surface of inner flange wall 36. The inner flange projection 42 extends away from the surface of the inner flange wall 36 for a distance which is relatively less than the projection of the edge wall 20. Upon insertion of the bottom portion 18, the outer flange projections 40 are placed in contact with the inner flange projections 42. The ends of the inner flange projection 42 are also in contact with the upper lower surface of the outer flange wall 34 on bottom portion 18. The projection of the outer flange projections 40 is less than the distance between the inner flange wall 36 and the outer flange wall 34 within the hollow portion defined therebetween. The sets of flange projections 40, 42 are engaged to form the support ribs 38. An adhesive or epoxy may be used to join these portions of the flange in assembling the reel 10.

The support ribs 38 create a stiffening of the flange 32 (FIG. 4) to prevent axial deflection on impact or upon receipt of a force adjacent its peripheral edge, such as being dropped on edge wall 20. In addition, the loading of wire or the like on the outer cylindrical wall 28 may cause an outwardly directed axially force against the inner flange walls 36 of the flanges 30 and 32. The support ribs 38 further stiffen the flanges so as to prevent deflection due to this winding of the wire thereon.

Figure 4:
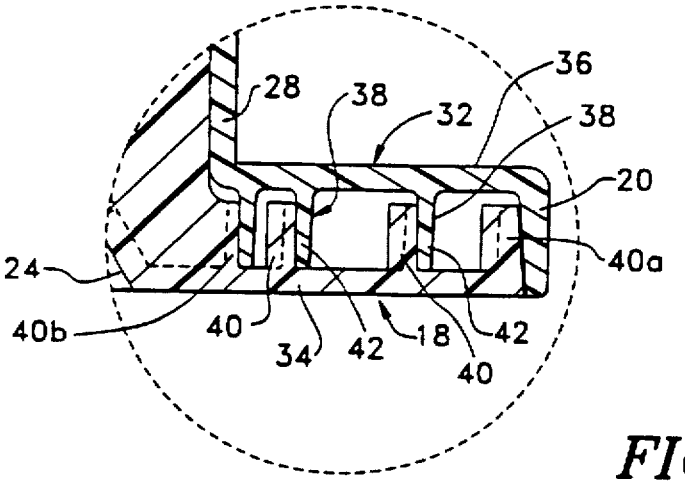
FIG. 4 is an enlarged partial cross-sectional view of a portion of the reel as taken from FIG. 3.
Figure 5:
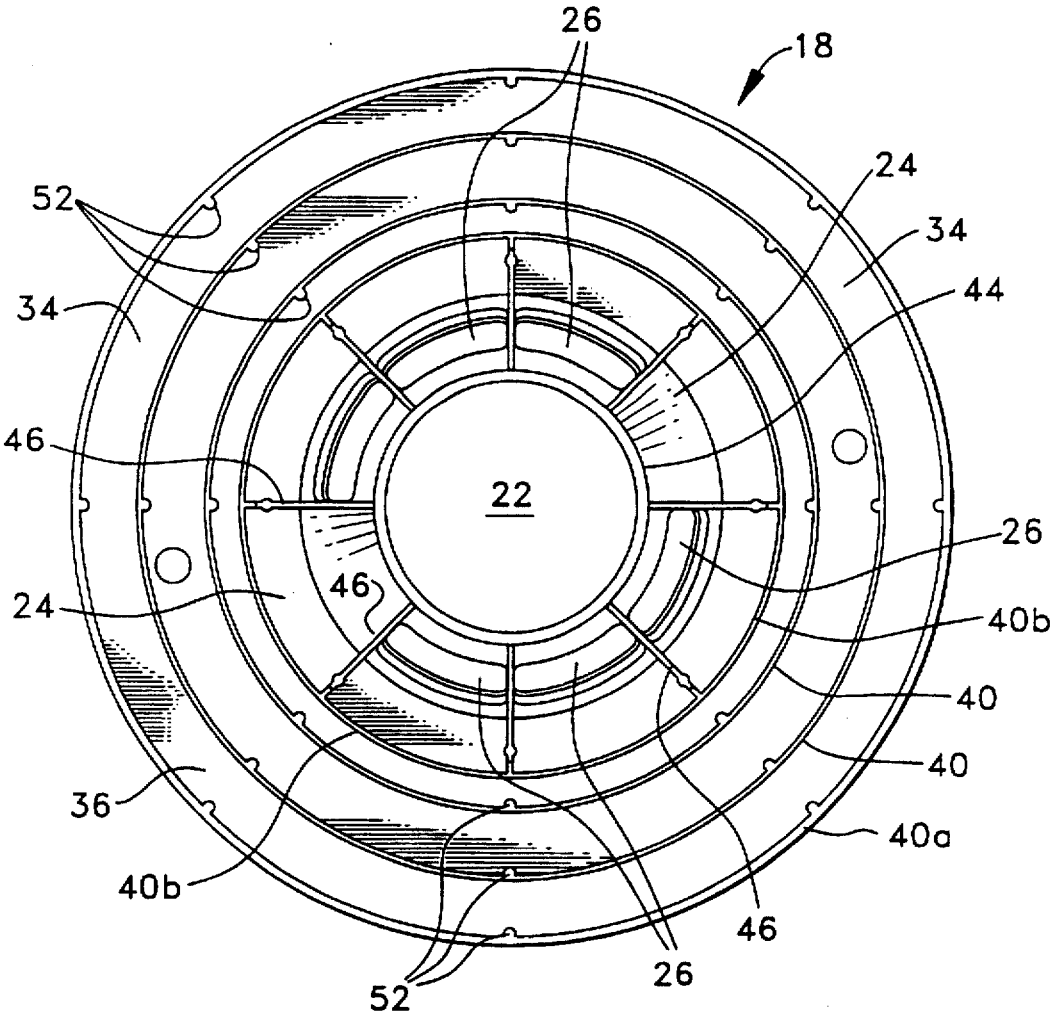
FIG. 5 is a bottom plan view of a portion of the reel.

In FIG. 5 there is shown a view of the internal structure of the bottom portion 18. As illustrated, the central hollow bore 22 as formed by the inner cylindrical wall 44 is defined centrally within the bottom portion 18. The angled or tapered wall 24 extends radially outwardly therefrom and includes the series of openings or windows 26 therein. FIG. 5 shows the internal surface of the outer flange wall 34 with the series of outer flange projections 40 extending perpendicular thereto. The radially outward-most flange projection 40*a* defines the outer peripheral edge of the bottom portion 18, as illustrated in FIG. 4. This peripheral outer flange projection 40*a* engages the inside surface of the edge wall 20 when the flange 32 is assembled (by insertion of the bottom portion 18 within the base portion 14).

Extending between the inner cylindrical wall 44 and the radially inward-most outer flange projection 40*b* is a series of radially projecting ribs 46. The radial ribs 46 extend radially outwardly from the inner cylindrical wall 44 to a position adjacent the tapered wall 24 where it joins the outer flange wall 34. As shown in FIG. 3, the height of the radial ribs 46 is slightly greater than the overall axial height of the tapered wall 24. Thus, the radial ribs 46 extend from the tapered wall to the outer cylindrical wall 28 on the bottom portion 18. Within the hollow area between the outer flange wall 34 on the bottom portion 18 and the inner flange wall 36 on the bottom portion 18, the radial ribs 46 extend radially outwardly and contact the inner-most outer flange projection 40*b*. The radially projecting ribs 46 serve to stiffen the flange 32 (and flange 30) and to increase the overall structural integrity of the reel 10. The ribs 46 also serve as spacers for the openings 26.

As also seen in FIG. 3, the inner cylindrical wall 44 of the bottom portion 18, when positioned within the base portion 14, extends into the central hollow bore 22 for a distance that is slightly less than half of the height of the reel 10. Thus, the projected end of the inner wall 44 on the bottom portion 18 is positioned closely adjacent the projected edge of the inner wall 44 on the top portion 16. An annular flange 48 extends inwardly from the outer cylindrical wall 28 on the base portion 14. At the inner edge of the annular flange 48 is provided an engagement flange 50, which is positioned generally perpendicular to the annular flange 48 and which extends in a generally axial direction. The engagement flange 50 includes a generally cylindrical surface having an inside diameter slightly greater than the outside diameter of the inner cylindrical wall 44. Thus, in final assembly, the engagement flange 50 is in contact with projected ends of the inner cylindrical walls 44 of both the top portion 16 and bottom portion 18. The engagement of the annular flange 48 with the inner cylindrical wall 44 of the top and bottom portions 16 and 18 further serves to stabilize the structural elements of the reel 10.

As illustrated in FIG. 5, a series of nubs are provided on the surfaces of the flange projections 40 on bottom portion 18. The nubs 52 are positioned at various radial locations and serve to maintain the perpendicular nature of the ribs 38 with respect to the flange walls. Similar nubs are provided on the corresponding inner flange projections 40 on top portion 16 and on projections 42 on the base portion 14. Such nubs are also incorporated into the peripheral edge of the radially projecting ribs 46 (FIG. 5) and can be seen through the openings 26 on the inside surface of the outer cylindrical wall 28 (FIG. 3). These nubs and enlarged areas tend to maintain the dimensional relationships between these elements so that a proper fit is created when the reel 10 is assembled.

Figure 6:
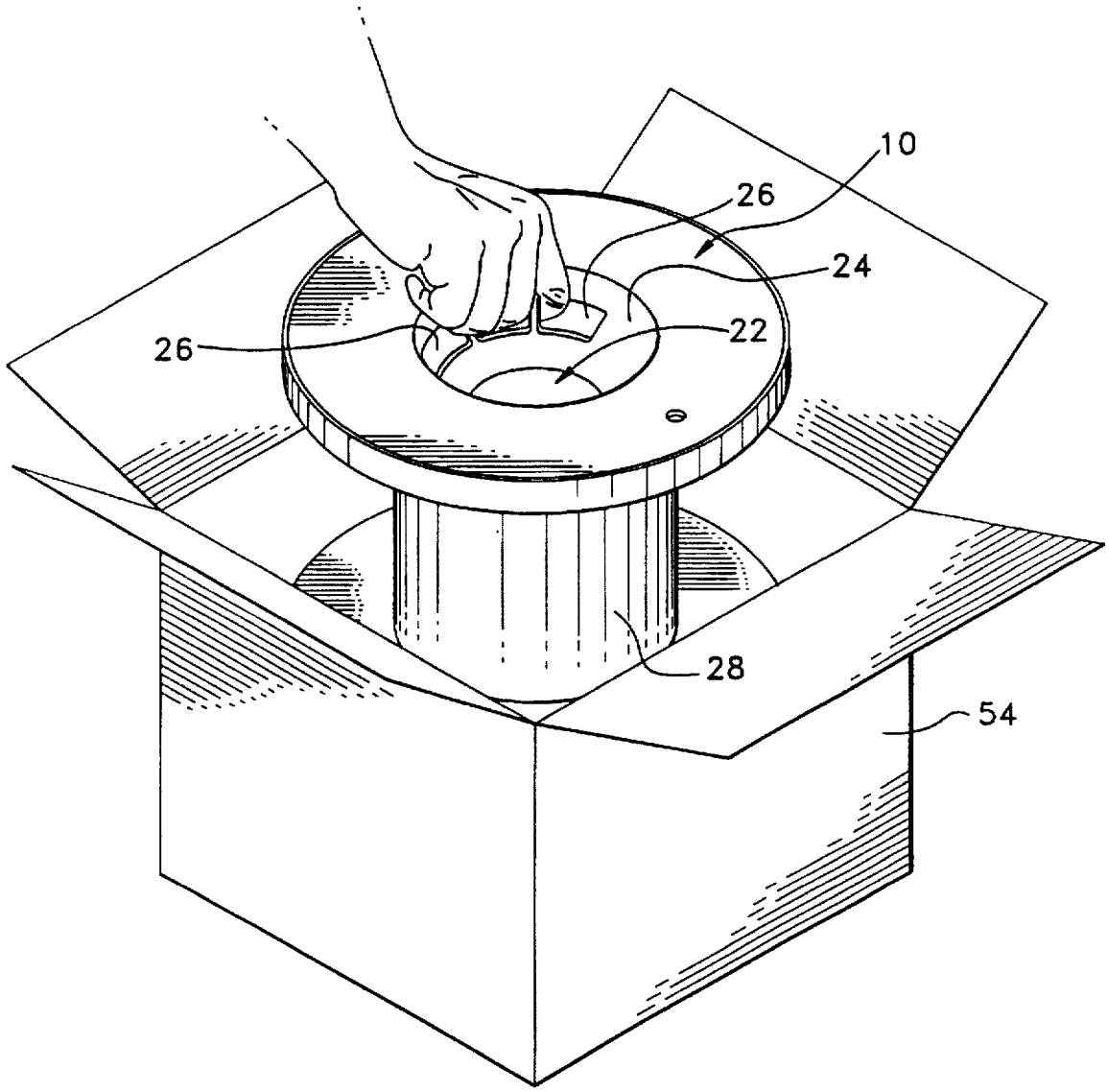
FIG. 6 is a prospective view of the assembled reel being inserted into a carton.

In FIG. 6, there is shown a reel 10 being inserted into a packaging carton 54. The reel 10 in FIG. 6 is shown without the wire wound on the outer cylindrical wall 28 between the flanges. When wire is wound on a typical reel, it becomes difficult to remove it from a carton. Two hands are typically required for removal. In addition, the lifter's hands are required to reach into the confines of the carton which may be difficult. In the present invention, windows 26 within the tapered wall 24 in the area of the central hollow bore 22 are provided such that a hand can reach into the interior of the reel 10 and remove the reel 10 from the carton 54. As shown in FIG. 5, the windows 26 are provided on opposite sides of the bottom portion (as well as the top portion 16) to balance the reel 10. The proper rotational environment for the reel is critical in high speed winding operations. The openings 26 create the necessary area for grasping and for removal of the reel 10 from the carton 54. Without the openings, the reel is difficult to remove from the packaging carton.

The present invention may be embodied in other specific forms without departing from the spirit or essential attributes thereof and, accordingly, reference should be made to the appended claims, rather than to the foregoing specification, as indicating the scope of the invention.

What is claimed is:

1. A reel for the winding and unwinding of wire, cable or the like, comprising:

a cylindrical hub, a pair of flanges attached to the cylindrical hub, one flange being positioned at each end of the hub and projecting radially outwardly therefrom, the hub comprising an inner cylindrical wall defining a central hollow bore through the center of the reel, an outer cylindrical wall concentrically formed with the inner wall, the outer face of the outer wall forming a barrel surface for receipt of a wire winding thereon, each flange on the reel extending radially outwardly from the barrel surface of the outer wall of the hub and further comprising a central frusto-conical wall connecting the inner wall of the hub to the outwardly projection portion of the flange, the frusto-conical wall tapering inwardly to the connection with the inner wall, the frusto-conical wall including at least one opening therein, providing a handle for lifting the reel.

2. A reel as claimed in claim 1, wherein the flange further comprises a first wall connected to the barrel surface and projecting radially outwardly therefrom, a second wall spaced from and parallel to the first wall, a cylindrical edge wall connecting the first wall to the second wall at their radial peripheral edges, the second wall extending inwardly from the edge wall and connected at its inner edge to the frusto-conical wall.

3. A reel as claimed in claim 2 further comprising means for stiffening the flanges so as to limit flexure thereof in the axial direction of the reel.

4. A reel as claimed in claim 3, wherein the stiffening means comprises a series of concentric cylindrical support ribs joining the first and second walls of the flange at spaced radial positions between the edge wall and the frusto-conical wall.

5. A reel as claimed in claim 4 further comprising a series of radial ribs extending outwardly from the frusto-conical wall and engaging the outer wall of the hub.

6. A reel as claimed in claim 5, wherein the radially extending ribs also connect the first and second walls of the flange.

7. A reel as claimed in claim 5, wherein the radial ribs extend outwardly to the radially inner-most cylindrical rib within the flange.

8. A reel as claimed in claim 7, wherein the inner-most concentric rib is positioned radially outwardly of the barrel surface of the hub.

* * * * *